US006148524A

United States Patent [19]

Nitschmann

[11] Patent Number: 6,148,524

[45] Date of Patent: Nov. 21, 2000

[54] LOW NOISE CUTTER ARRANGEMENT FOR A MOTOR-DRIVEN CHAIN SAW

[75] Inventor: Karl Nitschmann, Schorndorf, Germany

[73] Assignee: Andreas Stihl AG & Co., Waiblingen, Germany

[21] Appl. No.: 09/168,971

[22] Filed: Oct. 9, 1998

[30] Foreign Application Priority Data

Oct. 10, 1997 [DE] Germany ..... 197 44 888

[51] Int. Cl.[7] ..... B27B 17/02

[52] U.S. Cl. ..... 30/383; 30/381

[58] Field of Search ..... 30/381–387; 83/830–834

[56] References Cited

U.S. PATENT DOCUMENTS 3,390,710 7/1968 Cookson et al. ..... 30/381
4,203,215 5/1980 Ochiai et al. .
4,334,358 6/1982 Reynolds .

FOREIGN PATENT DOCUMENTS 4413015 10/1995 Germany .

*Primary Examiner*—Douglas D. Watts

*Attorney, Agent, or Firm*—Walter Ottesen

[57] ABSTRACT

The invention is directed to a low vibration and low noise cutter arrangement for a motor-driven chain saw. The cutter arrangement includes a guide bar and a saw chain. The guide bar has a guide groove for the saw chain which extends along the peripheral edges of the guide bar. The saw chain includes center links and side connecting links which are pivotally connected to each other. The connecting links on the right-hand and left-hand sides of the saw chain include cutting links and side links which are displaced relative to each other. The center links are provided with respective rakers which engage in the guide groove and can be driven in the longitudinal direction of the guide bar by a drive sprocket. The connecting links are supported with slide surfaces on the peripherally extending guide surfaces which lie at both sides of the guide groove. An elastically resilient spacer element is arranged between the guide bar and the saw chain in order to provide a significant reduction of the occurring vibrations and of the noise emissions. When the saw chain is not under load, the slide surfaces of the connecting links are held at a spacing relative to the guide surfaces of the guide bar and, when the saw chain is under load, the resilient spacer element yields until the connecting links are in contact engagement with the guide surfaces.

12 Claims, 3 Drawing Sheets

LOW NOISE CUTTER ARRANGEMENT FOR A MOTOR-DRIVEN CHAIN SAW

BACKGROUND OF THE INVENTION

U.S. Pat. No. 4,203,215 discloses a guide bar having a guide groove extending around the periphery thereof for accommodating a saw chain. The saw chain comprises center links and lateral connecting links which pivotally connect the center links to each other. The lateral connecting links are arranged on the right-hand and left-hand sides of the saw chain and include cutter links and side links whereas the center links are configured as drive links having respective rakers. The rakers are moved in the longitudinal direction of the guide bar by a drive sprocket of the motor-driven chain saw. The connecting links of the saw chain have slide surfaces with which they are supported on peripherally extending guide surfaces at both sides of the guide groove.

U.S. Pat. No. 4,203,215 discloses reducing the occurring vibrations by a specific structural configuration of the cutting teeth.

U.S. Pat. No. 4,334,358 discloses providing vibration-attenuating breakthroughs in the guide bar so that the vibrations caused by the saw chain do not become too great.

German patent publication 4,413,015 discloses a configuration wherein the peripheral edge of the guide bar, which guides the saw chain, is coupled to the central base body of the guide bar via attenuating elements. In this way, the vibrations generated by the saw chain are to be prevented from entering the base body of the guide bar.

Even though the various configurations lead to a reduction of vibrations in a cutter arrangement, a significant reduction of neither the vibrations nor the noise emission has been achieved.

SUMMARY OF THE INVENTION

It is an object of the invention to provide a cutter arrangement for a motor-driven chain saw which is so improved that the vibrations and noise emissions generated by the saw chain are significantly reduced.

The cutter arrangement of the invention is for a motor-driven chain saw having a drive sprocket. The cutter arrangement includes: a saw chain including a plurality of center links and a plurality of lateral connecting links, the links being pivotally interconnected and each of the center links having a raker extending downwardly beyond the lateral connecting links for coacting with the drive sprocket; a guide bar defining a peripheral edge; the guide bar having two mutually adjacent walls extending along the peripheral edge to conjointly define a groove for receiving the rakers of the center links therein to guide the saw chain as it is driven around the guide bar by the drive sprocket; the lateral connecting links including a plurality of cutting links on both sides of the chain saw offset with respect to each other and a plurality of side links; the lateral connecting links having respective slide surfaces; the groove walls having respective upper edges defining respective guide surfaces for receiving the lateral connecting links at the slide surfaces thereof in supporting contact engagement therewith as the saw chain moves around the guide bar; and, resilient spacer means disposed between the saw chain and the guide bar for acting on the saw chain to hold the slide surfaces of the lateral connecting links at a distance (a) from the guide surfaces of the guide bar when the saw chain is not under load and yielding up to contact engagement of the slide surfaces of the connecting links on the guide surfaces of the guide bar when the saw chain is under load.

With the arrangement of the spacer elements as provided by the invention, the friction contact between the saw chain and the guide bar is reduced to a minimum surface when the saw chain is not under load. In this way, the generation of vibrations is reduced and the noise emissions lowered. The basic idea of the invention is that a full-surface support of the slide surfaces of the saw chain on the guide surfaces of the guide bar is permitted only when the saw chain is under load and, for the unloaded saw chain, the friction contact is reduced by reducing the contact surfaces to a minimum.

The spacer element is advantageously so arranged that it operates either on the connecting links or on the center links or on both the connecting links and the center links.

In this context, it is sufficient to arrange the spacer elements between at least some connecting links and the guide bar or between at least some center links and the guide bar. Advantageously, the spacer element is provided between all connecting links and the guide bar or between all center links and the guide bar.

In a simple embodiment, the spacer element is formed from a resilient sheet metal lug which is attached to the saw chain or to the guide bar.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
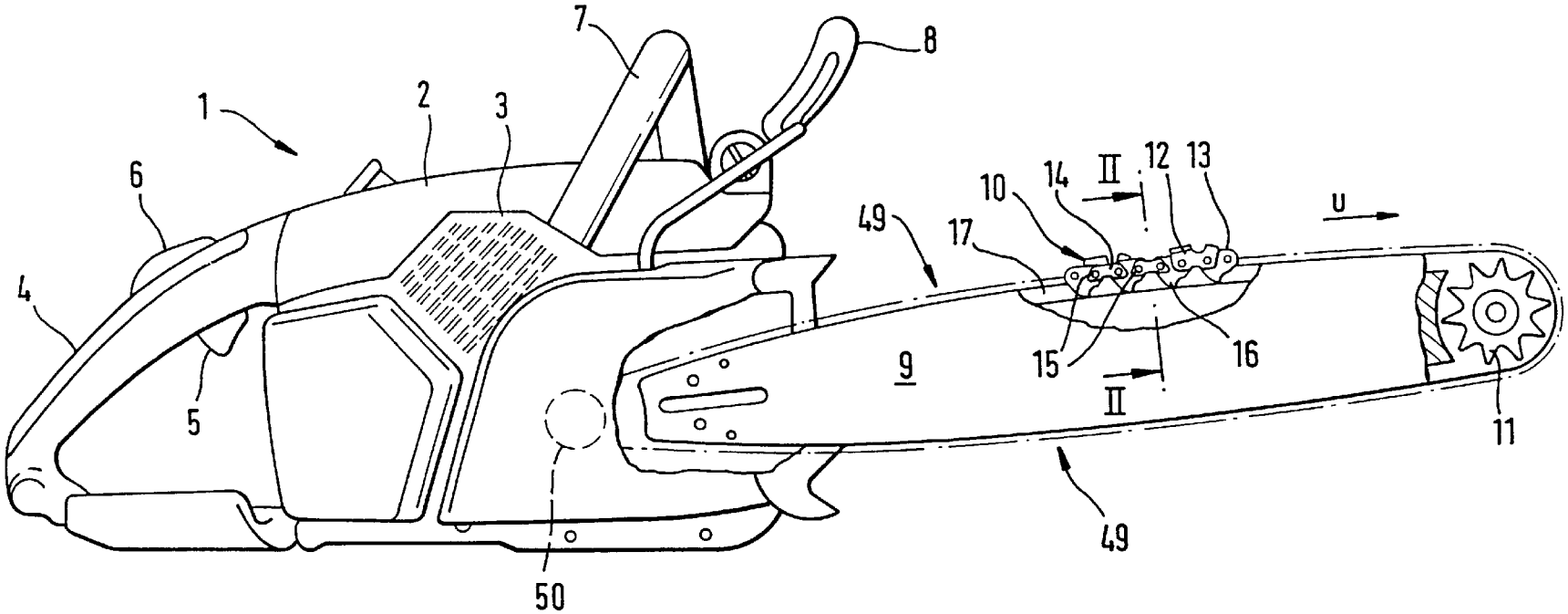
FIG. 1 is a side elevation view of a motor-driven chain saw equipped with a cutter arrangement according to the invention.

The motor-driven chain saw 1 shown in FIG. 1 includes essentially a housing 2 wherein a drive motor 3 is mounted for driving a saw chain 10 which moves on a guide bar 9. The guide bar 9 is fixed on the housing 2 of the chain saw 1. The saw chain 10 runs along the periphery of the guide bar 9 in the direction of arrow (u). A direction-changing wheel 11 is provided at the tip of the guide bar 9 for guiding the saw chain 10.

The chain saw 1 is held and guided utilizing handles 4 and 7 fixed on the housing. Rearward handle 4 extends in the longitudinal direction of the guide bar 9 in the rearward region of the housing 2. The handle 4 includes a throttle lever 5 and a throttle-lever latch 6 assigned to the throttle lever 5. The forward handle 7 is configured as a bail handle and extends from above the housing 2 into the side region of the chain saw 1. A guard lever 8 is arranged forward of the upper forward handle 7 and is connected to a safety brake device (not shown) for the saw chain 10.

Figure 8:
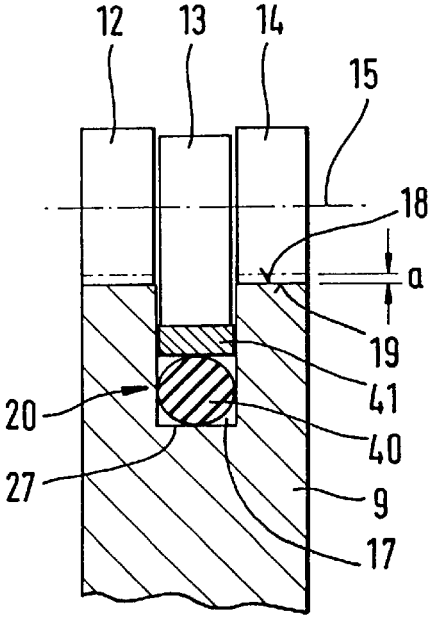

As shown in FIGS. 1 and 8, the saw chain 10 comprises center links 13 and side connecting links 12 and 14. The center links 13 and the side connecting links (12, 14) are pivotally connected to each other via rivets 15. The connecting links comprise simple side links 14 and cutting links 12 arranged so as to be displaced from each other and on left and right sides of the saw chain 10. The center links are configured as drive links 13 each having a raker 16 engaging in the peripherally extending guide groove 17 provided on the peripheral edge of the guide bar 9.

As shown in FIGS. 2 to 7, the connecting links have slide surfaces 18 at which they are supported on guide surfaces 19 extending in the peripheral direction and provided on both sides of the guide groove 17. In this way, the saw chain is slidingly supported by its connecting links (cutting links 12, side links 14); whereas, the drive sprocket 50, which is driven by the drive motor 3, engages the rakers 16 of the drive links 13 and drives the saw chain 10 in the peripheral direction. The connecting links lie on the guide surfaces 19 on both sides of the guide groove 17.

A spacer element 20 is arranged between the saw chain 10 and the guide bar 9 or, more specifically, between the saw chain 10 and the guide surfaces 19 formed on both sides of the guide groove 17. The spacer element 20 lifts the slide surfaces 18 of the connecting links (cutting links 12, side links 14) from the particular guide surface 19 when the saw chain is not under load. In the unloaded state of the saw chain, the connecting links (12, 14) are therefore no longer guided on the guide surfaces 19 of the guide bar 9 whereby an excitation of vibration and therefore also noise emission are prevented. Only when the saw chain 10 is under load does the spacer element 20 yield so that there is indirect or direct contact engagement of the slide surfaces of the connecting links (12, 14) with the guide surfaces 19. Accordingly, friction contact between the guide bar 9 and the saw chain 10 is only present when the saw chain is under load.

Figure 2:
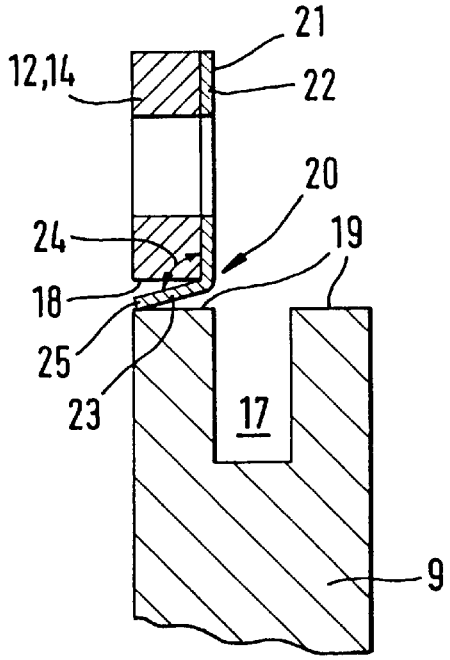
FIG. 2 is a detail view of a section taken along line II—II of FIG. 1 wherein the saw chain is not subjected to load.

In the embodiment of FIG. 2, the spacer element 20 is configured as an L-shaped chain part 21. The longer leg 22 lies parallel to the connecting links and is preferably between the connecting links (12, 14) and the center link 13 configured as a drive link. The leg 22 advantageously has the form of the side link 14. The shorter leg 23 of the chain part 21 engages under the connecting link (12, 14) and comes to lie between the slide surface 18 and the guide surface 19. The shorter leg 23 and the longer leg 22 conjointly define an angle 24 greater than 90° and less than 180°. At least the shorter leg 23 is deflected elastically from the rest position thereof shown in FIG. 2 in the direction toward the slide surface 18 on the connecting link (12, 14). Preferably, the chain part 21 is formed from a resilient sheet metal lug which can be stamped in the same manner as the connecting links (12, 14). The chain part 21 extends essentially in the peripheral direction of the guide bar over the length of the connecting link (12, 14) and is preferably mounted on each connecting link, that is, on each side cutting link 12 and each side link 14. It can be sufficient that the spacer element 20 is mounted between at least some connecting links and the guide bar.

As FIG. 2 shows, the connecting link (12, 14) is lifted from the guide bar 19 when the saw chain is not under load so that only the forward end 25 of the shorter leg 23 lies on the guide surface 19. In this way, the contact surface between the connecting links (12, 14) and the guide surface 19 is reduced to a minimum. The excitation to vibration and the emission of noise are therefore significantly reduced.

Figure 3:
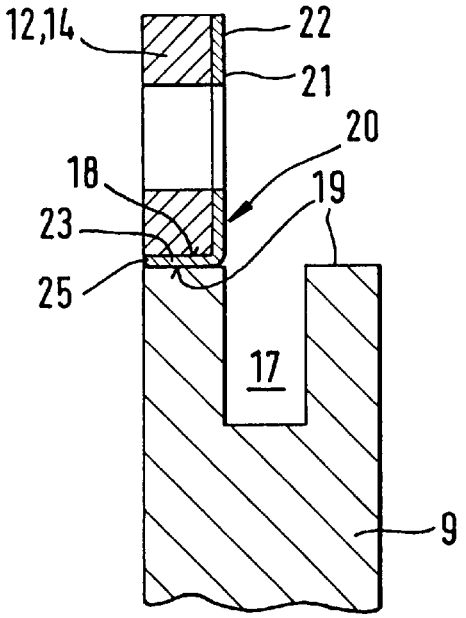
FIG. 3 is a detail view corresponding to the detail view of FIG. 2 wherein the saw chain is under load.

When the saw chain is under load, the shorter leg 23 is elastically deflected until it contact engages the slide surface 18 of the connecting link (12, 14) so that the connecting link lies on the guide surface 19 via the shorter leg 23 in a manner shown in FIG. 3. The forces introduced into the saw chain 10 are diverted into the guide bar 9 via the guide surfaces 19 as known per se. The spacer element 20 runs with the saw chain 10 because it is fixed to the connecting links (12, 14), that is, via the rivet bolts 15 which pivotally connect the connecting links (12, 14) to the center links 13.

Figure 4:
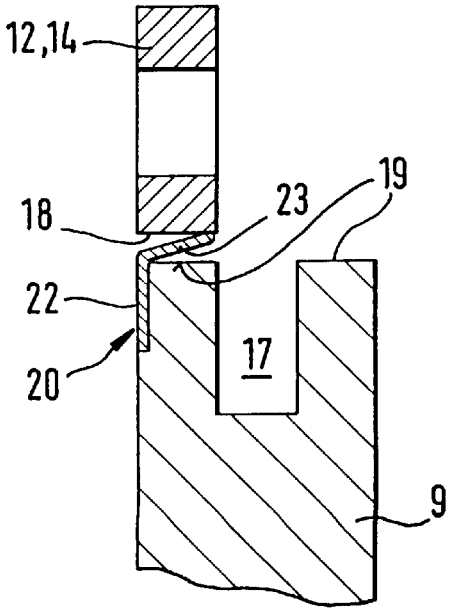
FIG. 4 is another embodiment of an arrangement of a spacer element for an unloaded saw chain in a view corresponding to the view shown in FIG. 2.
Figure 5:
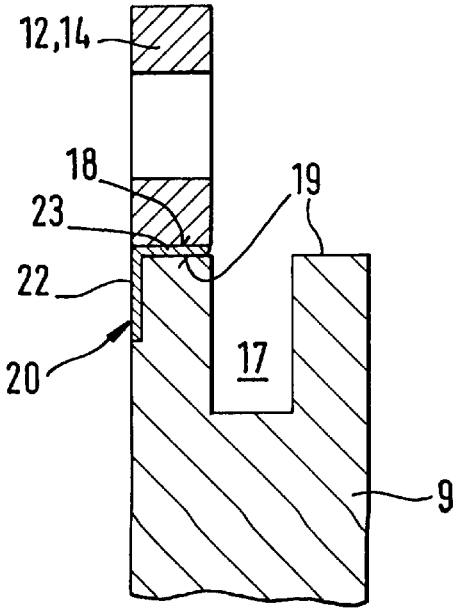
FIG. 5 corresponds to FIG. 4 except that the saw chain is under load.

In the embodiment of FIGS. 4 and 5, the spacer element 20 is fixed to the guide bar 9. Preferably, the spacer element 20 is again configured as an L-shaped component whose longer leg 22 is attached to the guide bar 9 and whose shorter leg 23 projects between the slide surface 18 and the guide surface 19. The shorter leg 23 has a length which corresponds to the width of the guide surface 19 so that, when the saw chain is loaded as shown in FIG. 5, the shorter leg 23 does not project beyond the guide surface 19. This selection of the length of the shorter leg 23 applies also to the embodiment of FIGS. 2 and 3.

Figure 6:
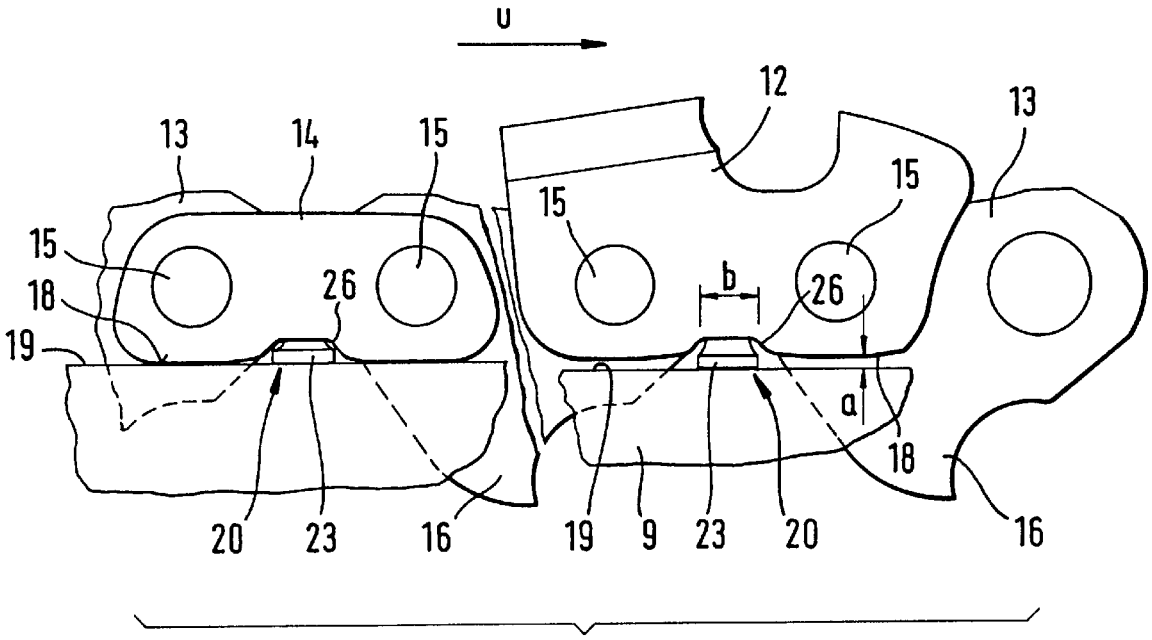
FIG. 6 is a detail side elevation view of a saw chain having spacer elements disposed in cutouts of the connecting links.

In the embodiment of FIG. 6, an L-shaped chain part 21 again defines the spacer element and is held on the saw chain 10. In FIG. 6, the shorter leg 23 lies on the guide surface 19 when the saw chain is in the unloaded state as shown in the right-hand portion of FIG. 6 and lifts the side cutting link 12 away from the guide surface 19 of the guide bar 9. The slide surface 18 of the cutting link 12 then lies at a spacing (a) to the guide surface 19.

The width (b) of the shorter leg 23 is measured in the peripheral direction and is slightly less than a recess 26 provided in the connecting link (cutting link 12). The recess 26 is provided approximately in the center between the rivets 15 viewed in the peripheral direction. The recess 26 has a depth perpendicular to the guide surface 19 so that the shorter leg 23 is accommodated in the recess 26 when the saw chain is under load as shown on the left-hand side of FIG. 6 with respect to the example of the side link 14. Accordingly, when the saw chain 10 is under load, the shorter leg 23 plunges into the recess 26 of the connecting link (12, 14) so that the connecting link 14 lies directly with its slide surface 18 on the guide surface 19 of the guide bar 9. In the unloaded state of the saw chain 10, the contact surface between the saw chain 10 and the guide surface 19 is thereby reduced to a minimum and vibrations and noise emissions are reduced.

The length of the chain part 21 (FIGS. 2, 3 and 6), which is measured in the peripheral direction, corresponds essentially to the length of a connecting link (12, 14) measured in the peripheral direction. In the embodiment of FIGS. 2 and 3, the shorter leg 23 corresponds essentially to the length of the connecting link; whereas, in the embodiment of FIG. 6, the shorter leg 23 is configured so as to be less than the slide surface 18. The shorter leg 23 corresponds in its length (measured in the peripheral direction) approximately to the width of the recess 26.

In the embodiment of FIGS. 4 and 5, the spacer element 20 is configured as a resilient sheet metal piece and is so configured that it corresponds approximately to the peripheral length of the guide bar 9. It can be advantageous to configure the spacer element 20 in accordance with FIGS. 4 and 5 only in a length which corresponds to one longitudinal side 49 of the guide bar.

Figure 7:
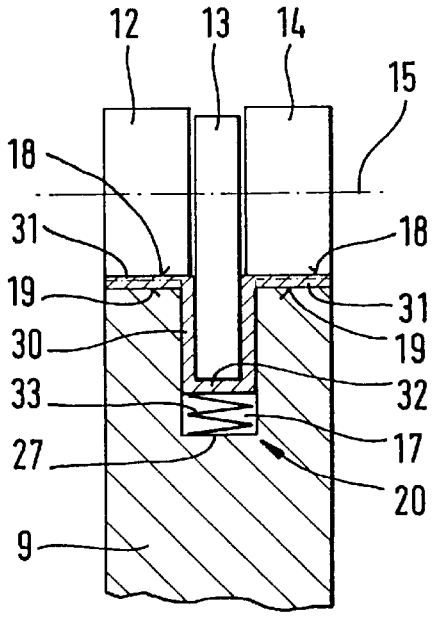
FIG. 7 is another embodiment of the arrangement of the spacer element between the saw chain and the guide bar; and, FIG. 8 is still another embodiment of the configuration of the spacer element in the guide groove of a guide bar.

In the embodiment of FIG. 7, an insert 30 is seated in the guide groove 17 of the guide bar 9. This insert 30 has a U-shaped profile when viewed in section. The U-shaped insert 30 extends preferably over the entire length of a longitudinal side 49 of the guide bar 9 and engages with bent over leg ends 31 between the connecting links (12, 14) of the saw chain and the guide surfaces 19 at the periphery of the guide bar 9. The U-shaped insert 30 preferably comprises a low friction wear-resistant material. The center links 13, which are configured as drive links, are guided in the U-shaped insert 30.

Helical springs 33 are arranged between the base 32 of the insert 30 and the bottom 27 of the guide groove 17 and are distributed along the longitudinal side 49 of the guide bar 9, preferably uniformly. The helical springs 33 are braced with one end on the bottom 27 of the guide groove and are supported with the other end on the base 32 of the U-shaped insert 30. For the unloaded saw chain 10, the helical springs 33 lift the insert 30 so that an air gap is provided between the leg ends 31 and the guide bar 9 as shown in phantom outline. For the loaded saw chain, the force, which acts on the leg ends 31, presses the insert 30 into the guide groove 17 until the connecting links (12, 14) are supported via the leg ends 31 on the guide surfaces 19.

In lieu of helical springs 33, leaf springs or like resilient elements can be used.

In the embodiment of FIG. 8, the saw chain is lifted from the guide bar 9 exclusively via the center links 13. For this purpose, a spacer element 20 is arranged in the guide groove 17. The spacer element 20 is made of an elastic filament 40, such as a rubber ring or the like, and a transmitting strip 41. The center links 13 of the saw chain 10 lie with their respective rakers 16 on the transmitting strip 41 which, in turn, lies on the elastic filament 40. The filament 40 extends at least over one longitudinal side 49 of the guide bar 9 and preferably over both longitudinal sides or over the entire periphery of the guide groove 17. The transmitting strip 41 extends essentially over respective longitudinal sides 49 of the guide bar 9. The transmitting strip 41 of a longitudinal side 49 is advantageously subdivided into individual longitudinal segments.

In the loaded state shown in FIG. 8, the saw chain 10 lies with the slide surfaces 18 of the connecting links (12, 14) on the guide surfaces 19 of the guide bar 9. The drive links 13 press against the transmitting strip 41 which is displaced in the direction toward the groove bottom 27 in the guide groove 17 while the filament 40 elastically deforms.

For a saw chain 10 not under load, the filament 40 relaxes and lifts the transmitting strip 41 whereby the connecting links (12, 14) are lifted via the center links 13 so that an air gap is provided between the slide surfaces 18 and the guide surfaces 19. The surfaces which are in mutual contact are reduced to a minimum. The excitation of vibration and the emission of noise are significantly reduced.

It is understood that the foregoing description is that of the preferred embodiments of the invention and that various changes and modifications may be made thereto without departing from the spirit and scope of the invention as defined in the appended claims.

What is claimed is:

1. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load; and, said resilient spacer means being arranged between all of said lateral connecting links and said guide bar.

2. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide surfaces of said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load; and, said resilient spacer means being fixed on said saw chain.

3. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load; and, said resilient spacer means being a resilient sheet metal lug.

4. The cutter arrangement of claim 3, wherein said resilient sheet metal lug extends in the peripheral direction (u) of said guide bar.

5. The cutter arrangement of claim 4, wherein said guide bar has a predetermined side length and said resilient sheet metal lug has a length measured in said peripheral direction (u) which corresponds approximately to said predetermined side length of said guide bar.

6. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load; and, said resilient spacer means including a plurality of resilient sheet metal lugs attached to corresponding ones of said lateral connecting links.

7. The cutter arrangement of claim 6, wherein said links are pivotally interconnected with rivets and said resilient sheet metal lugs are attached to said rivets.

8. The cutter arrangement of claim 6, wherein each of said resilient sheet metal lugs has a length measured in the peripheral direction and said length corresponding approximately to the length of one of said lateral connecting links.

9. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said Peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load;

said resilient spacer means being fixed on said guide bar;

said resilient spacer means being fixed in said guide groove of said guide bar;

said resilient spacer means including: a plurality of springs supported in said guide bar; and, a transmitting element interposed between said saw chain and said plurality of springs; and, said transmitting element being a U-shaped insert seated in said guide groove; and, said U-shaped insert having bent over leg ends disposed between said guide surfaces and said lateral connecting links.

10. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting contact engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to contact engagement of said slide surfaces of said connecting links on said guide surfaces of said guide bar when said saw chain is under load; and, said resilient spacer means including: an elastic filament disposed in said guide groove of said guide bar; and, a transmitting element interposed between said elastic filament and said saw chain.

11. The cutter arrangement of claim 10, wherein said elastic filament is disposed at least in straight segments of said guide groove; and, said elastic filament having a circular cross section.

12. A cutter arrangement for a motor-driven chain saw having a drive sprocket, the cutter arrangement comprising:

a saw chain including a plurality of center links and a plurality of lateral connecting links, said links being pivotally interconnected and each of the center links having a raker extending downwardly beyond the lateral connecting links for coacting with said drive sprocket;

a guide bar defining a peripheral edge;

said guide bar having two mutually adjacent walls extending along said peripheral edge to conjointly define a groove for receiving the rakers of said center links therein to guide the saw chain as it is driven around the guide bar by said drive sprocket;

said lateral connecting links including a plurality of cutting links on both sides of said chain saw offset with respect to each other and a plurality of side links;

said lateral connecting links having respective slide surfaces;

said groove walls having respective upper edges defining respective guide surfaces for receiving said lateral connecting links at said slide surfaces thereof in supporting engagement therewith as said saw chain moves around said guide bar;

resilient spacer means disposed between said saw chain and said guide bar for acting on said saw chain to hold said slide surfaces of said lateral connecting links at a distance (a) from said guide surfaces of said guide bar when said saw chain is not under load and yielding up to supporting engagement of said slide surfaces of said connecting links on said guide surfaces of said guide bar when said saw chain is under load; and, at least one of said lateral connecting links having a recess; and, said resilient spacer means being disposed in said recess when said saw chain is subjected to load.

* * * * *